US005184707A

United States Patent [19]

Van Horn et al.

[11] Patent Number: 5,184,707

[45] Date of Patent: Feb. 9, 1993

[54] COIN OPERATED TIMING MECHANISM

[75] Inventors: John W. Van Horn, Harrison, Ark.; Ralph H. Carmen, Lebanon, N.J.

[73] Assignee: Duncan Industries Parking Control Systems Corp., Harrison, Ak.

[21] Appl. No.: 831,423

[22] Filed: Feb. 5, 1992

Related U.S. Application Data

[63] Continuation of Ser. No. 384,781, Jul. 24, 1989, Pat. No. 5,109,972.

[51] Int. Cl.[5] ..... G07F 17/24

[52] U.S. Cl. ..... 194/204; 194/217; 194/219

[58] Field of Search ..... 194/203, 204, 200, 216, 194/217, 218, 219, 223, 230, 241, 243; 340/683

[56] References Cited

U.S. PATENT DOCUMENTS

| | | | |
|---|---|---|---|
| 2,893,531 | 7/1959 | Hebel | 194/204 |
| 3,482,110 | 12/1969 | Robinson | 194/204 X |
| 3,998,309 | 12/1976 | Mandas et al. | 194/203 |
| 4,080,598 | 3/1978 | Cardone | 194/204 X |
| 4,792,032 | 12/1988 | Shapiro | 194/243 |

*Primary Examiner*—F. J. Bartuska
*Attorney, Agent, or Firm*—James P. Ryther

[57] ABSTRACT

A coin operated timing mechanism for a parking meter and the like including a time display, a microprocessor for controlling the setting and operation of the display, a battery or similar self-contained power source, and a power regulation sub-system designed to minimize power consumption during operation of the mechanism. The power regulation system provides, on demand, voltage of either 3.5 or 5 volts. The higher power consumption 5-volt supply is available when necessary for short periods to read a NOVRAM device which stores operational parameters. The 3.5 volt mode is used during normal coin handling and timekeeping and during periods of communication wiht the microprocessor for changing the operating parameters or for auditing of the system. The mechanism includes coin actuated switches which are adjustable to insure most efficient operation including screening of spurious coins. The circuit includes a low power drain feature which operates upon actuation of a switch to permit computation by the microprocessor at a slow rate.

4 Claims, 7 Drawing Sheets

FIG. 2A
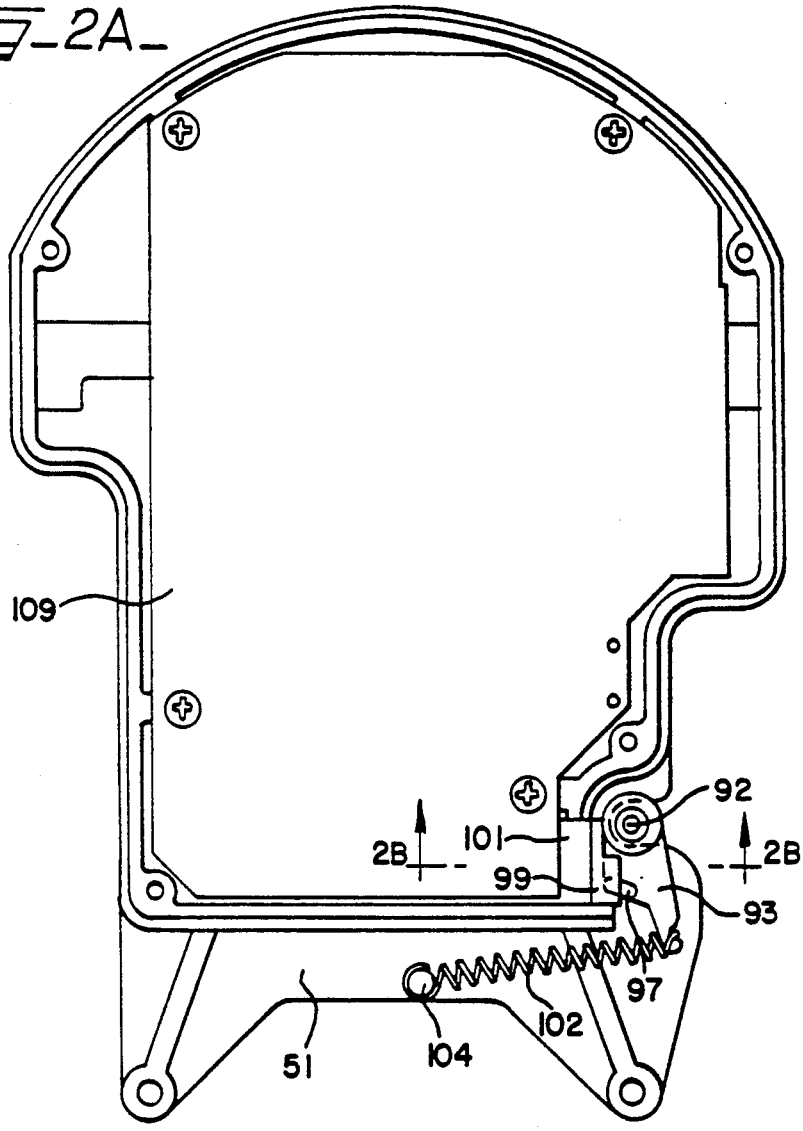
FIG. 2B
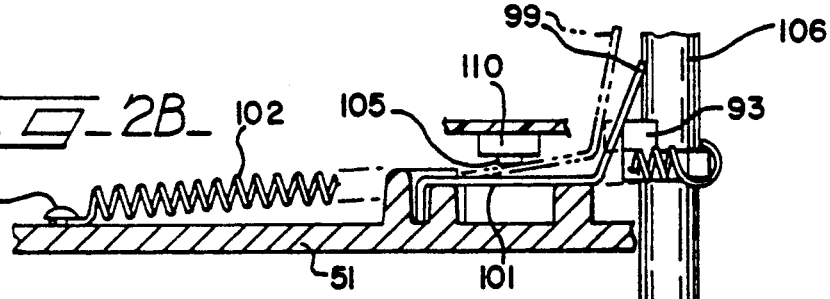
FIG. 3A
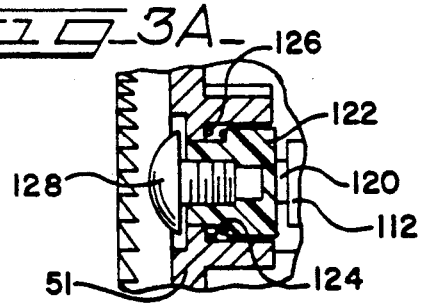
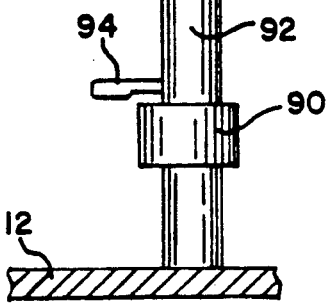

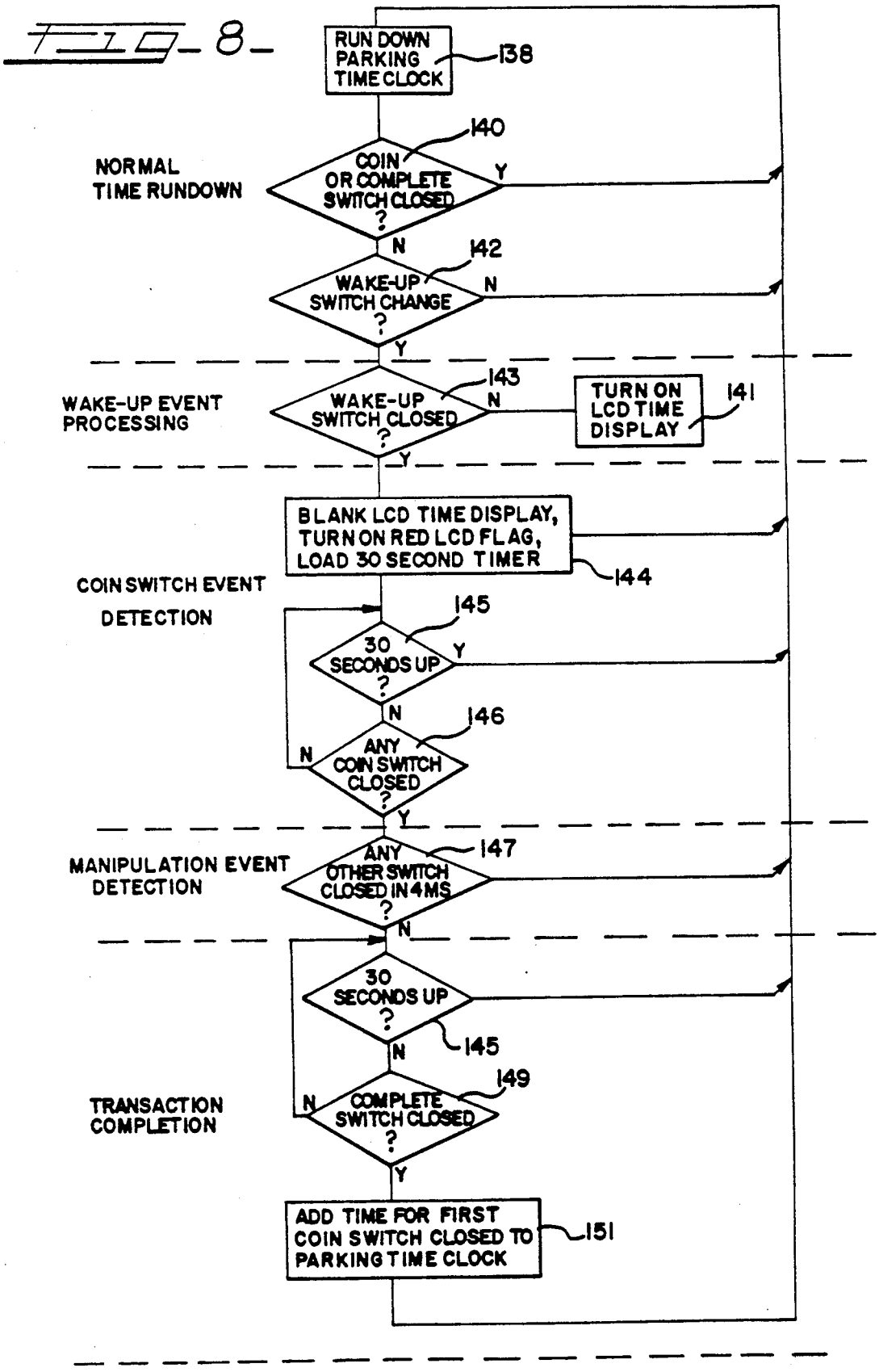
FIG. 8
RUN DOWN PARKING TIME CLOCK
138
NORMAL TIME RUNDOWN
COIN OR COMPLETE SWITCH CLOSED ?
140
Y
N
WAKE-UP SWITCH CHANGE ?
142
N
Y
WAKE-UP EVENT PROCESSING
WAKE-UP SWITCH CLOSED ?
143
N
TURN ON LCD TIME DISPLAY
141
Y
BLANK LCD TIME DISPLAY, TURN ON RED LCD FLAG, LOAD 30 SECOND TIMER
144
COIN SWITCH EVENT DETECTION
30 SECONDS UP ?
145
Y
N
ANY COIN SWITCH CLOSED ?
146
N
Y
MANIPULATION EVENT DETECTION
ANY OTHER SWITCH CLOSED IN 4 MS ?
147
N
30 SECONDS UP ?
145
N
TRANSACTION COMPLETION
COMPLETE SWITCH CLOSED ?
149
N
Y
ADD TIME FOR FIRST COIN SWITCH CLOSED TO PARKING TIME CLOCK
151

COIN OPERATED TIMING MECHANISM

This is a continuation, of application Ser. No. 384,781, filed July 24, 1989, now U.S. Pat. No. 5,109,972.

BACKGROUND OF THE INVENTION

This invention relates to a coin operated timing mechanism. The mechanism is useful, for example, in the field of parking meters and like devices where, upon insertion of a coin, token or other device, a counting period or timing interval begins. The term "coin" as used hereinafter is intended to cover legal tender as well as tokens or similar devices.

The timing interval in such mechanisms is usually determined by the number and value of the coins inserted into the device. While the present invention is most specifically adapted for use as a parking meter for automobiles, it will be appreciated that the design is also intended for use in other environments. In general, the meter of the present invention can be used wherever it is desired to control a period of use depending upon the insertion of a number of coins.

Sollenberger U.S. Pat. No. 2,603,288 discloses an example of parking meters of the type which have been most widely used. Those meters employ primarily mechanical devices utilizing springs, gears, and like mechanical components to accomplish the desired purpose. A drawback in the use of solely mechanical components is the degree of servicing which is often required by such units. The parts wear and require lubrication and replacement at frequent intervals.

In the electronic field, devices for timing events have been known such as disclosed in Malott U.S. Pat. No. 4,031,991. Such meters may be more suitable for operation under severe temperature conditions, and an electronic design may increase servicing intervals. Other advantages include the ability to obtain a variety of options which are not easily implemented in mechanical meters. For example, by programming the electronics of the Malott system, each coin inserted by a user at a given time can be assigned a different value, i.e., the first quarter dollar inserted in the meter might correspond to two hours of parking time while a second quarter would correspond to one hour and a third quarter 30 minutes. Alternatively, if desired, a constant rate for each coin can be provided. An additional feature which is easily incorporated is what is referred to as MRP or "maximum revenue production" whereby when a motorist pulls into a parking space he is compelled to insert coins rather than to depend upon the time purchased by the previous user of the space.

The Malott disclosure recognizes that the rotatable handle and associated mechanism parts of a mechanical meter can be utilized for developing signals which function in an electronic system. Selby U.S. Pat. No. 3,757,916 and Shapiro U.S. Pat. No. 4,792,032 also utilize this general concept in connection with electronic parking control systems. Both the Malott and Shapiro disclosures also recognize that the traditional "flagging" functions of mechanical meters, i.e., visual displays indicating a violation or an expired time condition, are desirably incorporated in an electronic meter.

Rubenstein U.S. Pat. No. 3,930,363 and U.K. Patent Application No. 2,077,475, published Dec. 16, 1981, also disclose electronically controlled parking meters. In the latter instance, emphasis is placed on the use of CMOS (complementary metal oxide) integrated circuitry to achieve operation with low power consumption.

SUMMARY OF THE INVENTION

The electronic system utilized with the timing mechanism of this invention is particularly characterized by a power regulation sub-system which overcomes drawbacks found in prior art systems. In this connection, low power consumption is a highly desirable feature of an electronic timing mechanism for products such as parking meters since such products are typically located where no efficient access to electrical power lines is available. Accordingly, batteries or similar self-contained sources of power must be utilized, and the rate of power consumption must be kept to a minimum in order to avoid frequent and expensive servicing, and in order to avoid malfunctions due to inadequate power availability.

The power regulation sub-system of this invention permits efficient utilization of relatively low cost battery power, such as a 9-volt battery commonly used, for example, in a transistor radio. Such batteries are readily available, and they carry contacts which permit easy field changeovers when this is required.

Such batteries have the drawbacks, however, of somewhat limited capacity and of steep voltage characteristics. The power regulation sub-system of this invention addresses these drawbacks by minimizing power drain thereby maximizing the useful life of such batteries. Moreover, voltage regulation in the sub-system accommodates for the steep voltage characteristic.

More specifically, the power regulation sub-system is used in conjunction with low power consumption circuit technology such as a CMOS integrated circuit. Typically, such a circuit operates most efficiently at a regulated voltage of about 3 volts. In addition, a NOVRAM component for storing the system operational parameters is employed, and this component requires a regulated voltage of about 5 volts Communication with the microprocessor used in the operation, or auditing thereof, may demand a regulated voltage of about 3.5 volts. To accommodate these varying requirements, the power regulation sub-system of the invention operates to provide, on demand, either 3.5 volts or 5 volts, and the capability does not depend on continuous bias of a reference diode.

Additional saving of power consumption is provided by employing capacitors in conjunction with the switches actuated by coins inserted in the meter. The circuitry is designed so that a large amount of charge is transmitted in a very short interval (on the order of 130 microseconds) when a switch is actuated with this charge being stored on a capacitor associated with the switch. High resistance is interposed in the line which normally maintains the capacitor in a discharged state. When a switch is released, the capacitor discharges slowly allowing the microprocessor to scan the switches over a relatively long period (on the order of 10 milliseconds) thereby operating at a low clock rate with associated low consumption of power.

The mechanisms of the invention include switches selectively actuatable depending on the denominations of coins inserted in the meter. The switch actuation may be affected by employing pawls of the type normally employed for operating the winding ring of a meter with a mechanically operated clock mechanism. In such a system, the pawls include one which pivots outwardly in response to engagement of a coin with a cam surface, and this pivoting action can be used for switch actuation in the system of this invention.

The preferred switch actuators include means for adjustment so that each meter employing the invention can be accurately set for most reliable operation. In addition, the system involves the requirement for multiple switch operations within particular time intervals so as to avoid spurious operation which might otherwise by caused accidentally or by someone attempting to cheat the meter.

The particular switch structure also minimizes the likelihood of spurious coins being used by purchasers of time. Thus, this structure includes means for adjusting the distance between switch actuators and the opposed coin engaging surface. Accordingly, only coins of sufficient diameter will actuate switches for purposes of purchasing time.

BRIEF DESCRIPTION OF THE DRAWINGS

FIG. 2A is a rear elevational view illustrating the PC board arrangement and wake-up switch utilized in the assembly;

FIG. 2B is a fragmentary, sectional view illustrating the "wake up" switch arrangement of the invention taken about the line 2B—2B of FIG. 2A;

FIG. 3A is a fragmentary, sectional view of a coin actuated switch and actuator structure;

FIG. 8 is a schematic illustration of the operating sequence of the timing mechanism assembly; and, FIG. 9 is a diagram illustrating portions of the circuitry utilized in the assembly.

DESCRIPTION OF THE PREFERRED EMBODIMENTS

The instant invention will be specifically described with reference to a parking meter. In such meters there are usually a plurality of coin slots whereby coins of different denominations can be employed.

Figure 1:
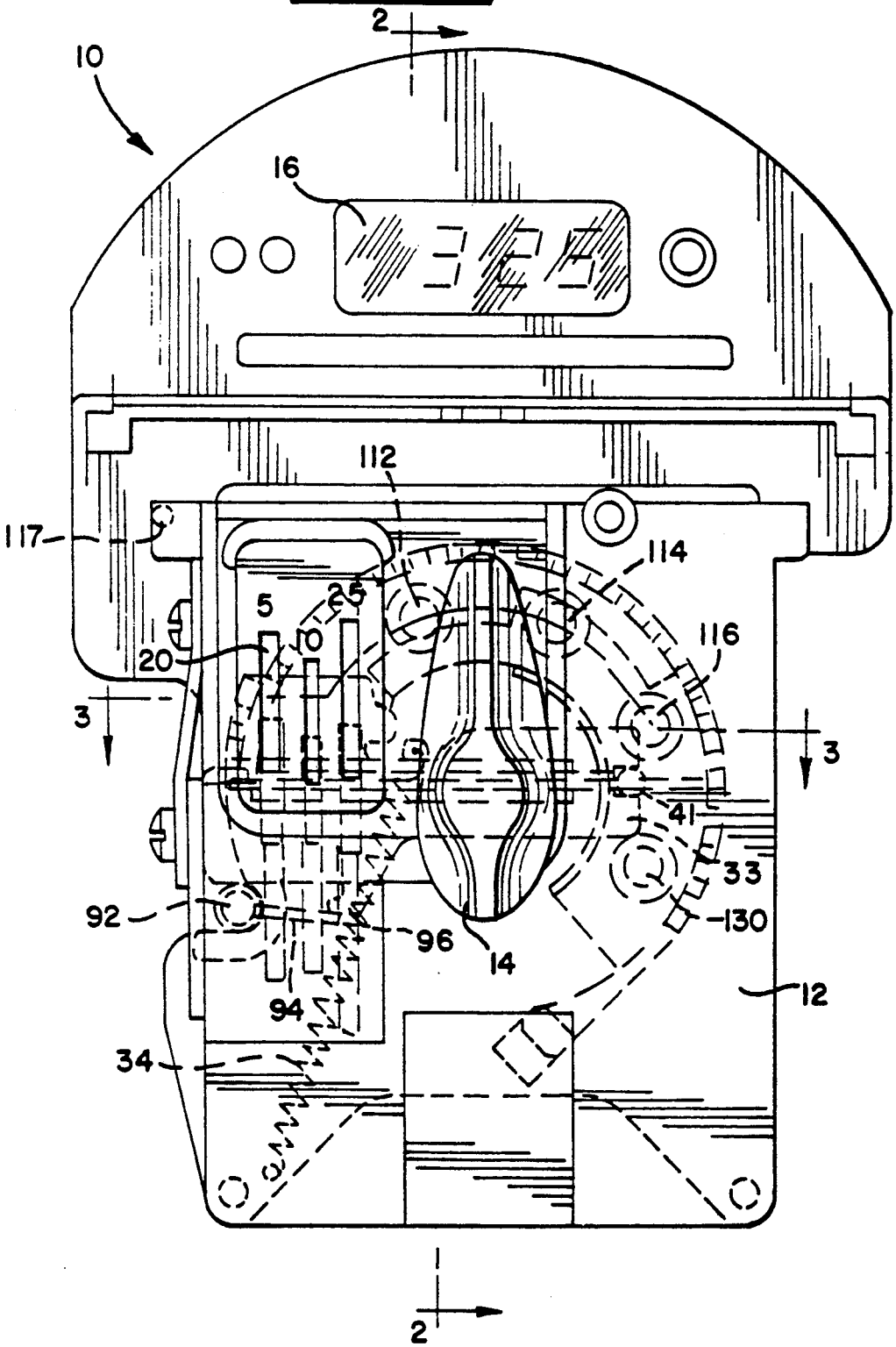
FIG. 1 is a front elevational view of a parking meter timing mechanism assembly characterized by the features of this invention.

The meter 10 shown in FIG. 1 illustrates one type of meter which can be employed in combination with the timing mechanism of this invention. The meter includes a front panel 12 which carries a handle 14 adapted to be rotated for the setting of time on the meter. The time set on the meter is recorded on LCD digital display 16 or the like. Openings 20 are provided on the face of the meter for receiving coins of different denominations. It will be appreciated that the instant invention could apply to an apparatus employing a single coin, or any one of various combinations.

Figure 3:
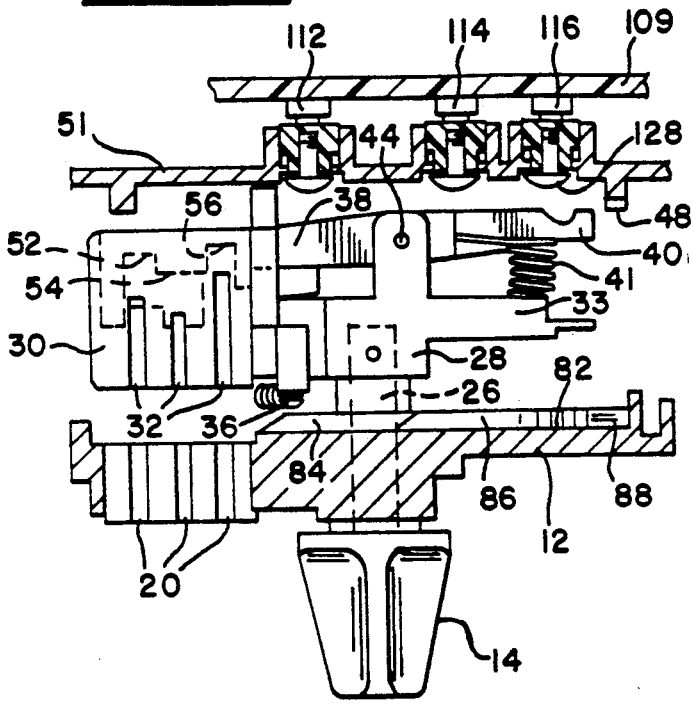
FIG. 3 is a fragmentary, horizontal sectional view of the assembly taken about the line 3—3 of FIG. 1.
Figure 2:
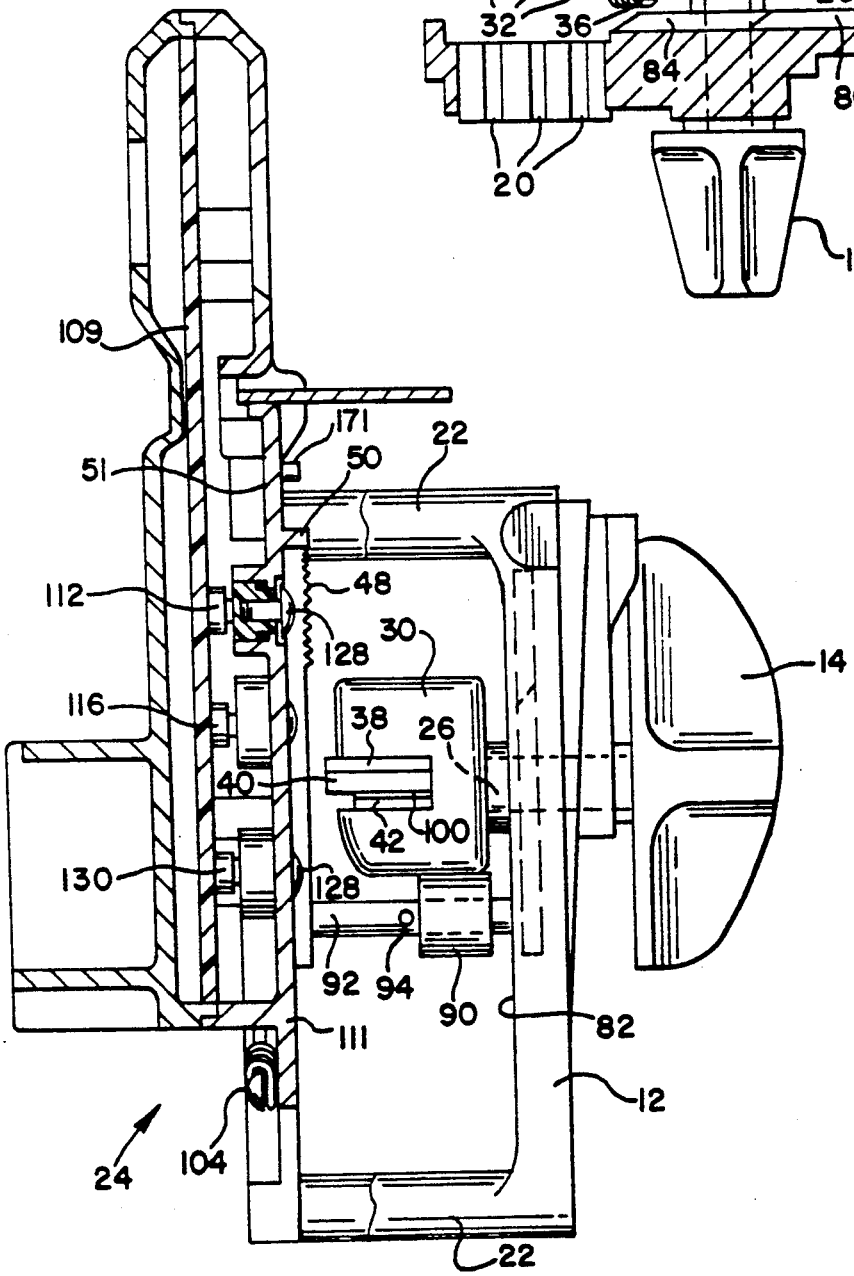
FIG. 2 is a vertical sectional view of the assembly taken about the line 2—2 of FIG. 1.

As shown in FIGS. 2 and 3, behind the front panel 12 there are provided support posts 22 for carrying a timing mechanism 24. Intermediate the timing mechanism and the front panel, there are provided the elements which are operated by the handle 14 for setting of the time on the meter. Although a description of the operation of these elements common to prior art meters will be provided herein in only general terms, reference can be made to U.S. Pat. Nos. 1,799,056, 2,070,445 and 3,262,540 for a more specific description.

The handle 14 is tied to shaft 26 whereby rotation of the handle will provide for rotation of this shaft. Also tied to the shaft on the inside of the front wall is a member 28 which comprises a coin carrier 30 extending in one direction from the shaft, and an arm 33 extending in the opposite direction. The coin carrier defines a plurality of coin slots 32 which are aligned with the openings 20 when the coin carrier is in its coin-receiving position. A spring 34 is secured at one end to the panel 12, while the other end is attached at 36 to the member 28 whereby the coin carrier is normally at the coin-receiving position shown in FIG. 1.

Referring also to FIGS. 4–7, a ratchet pawl 38, a coin pawl 40, and a switch pawl 42 are pivotally attached to the member 28 by means of a pivot pin 44. The pawl 38 includes an end portion 46 which is provided for engagement with the teeth 48 of a stationary ratchet 50 carried by wall 51.

Figure 4:
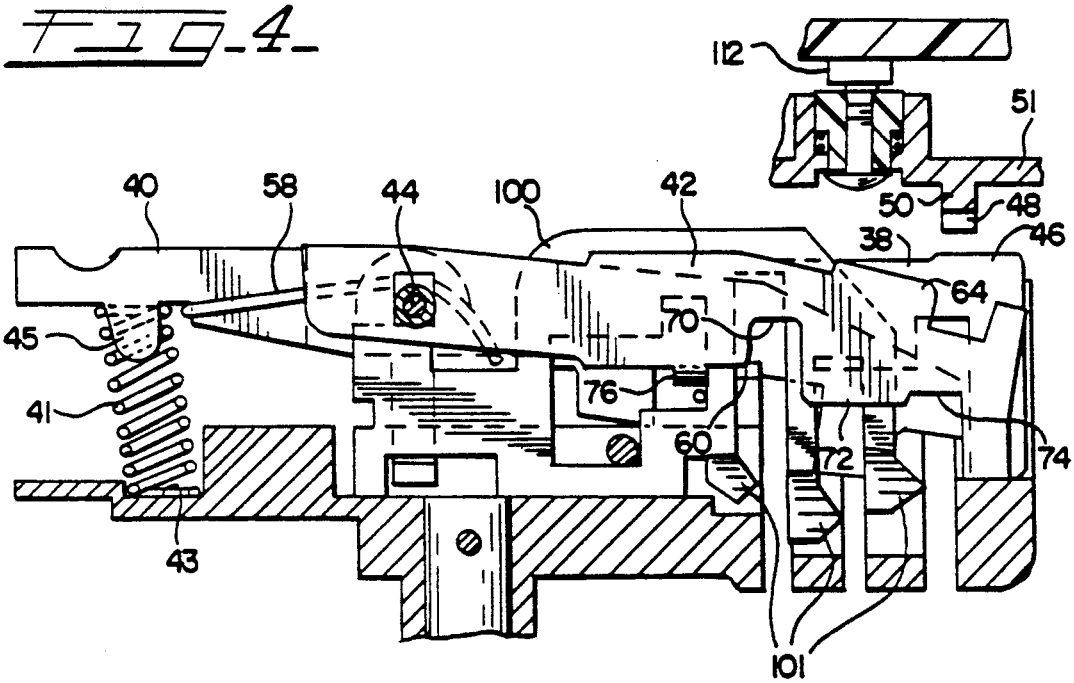
FIG. 4 is a fragmentary, horizontal sectional view of the assembly showing the coin carrier in a rotated position without a coin inserted therein.
Figure 5:
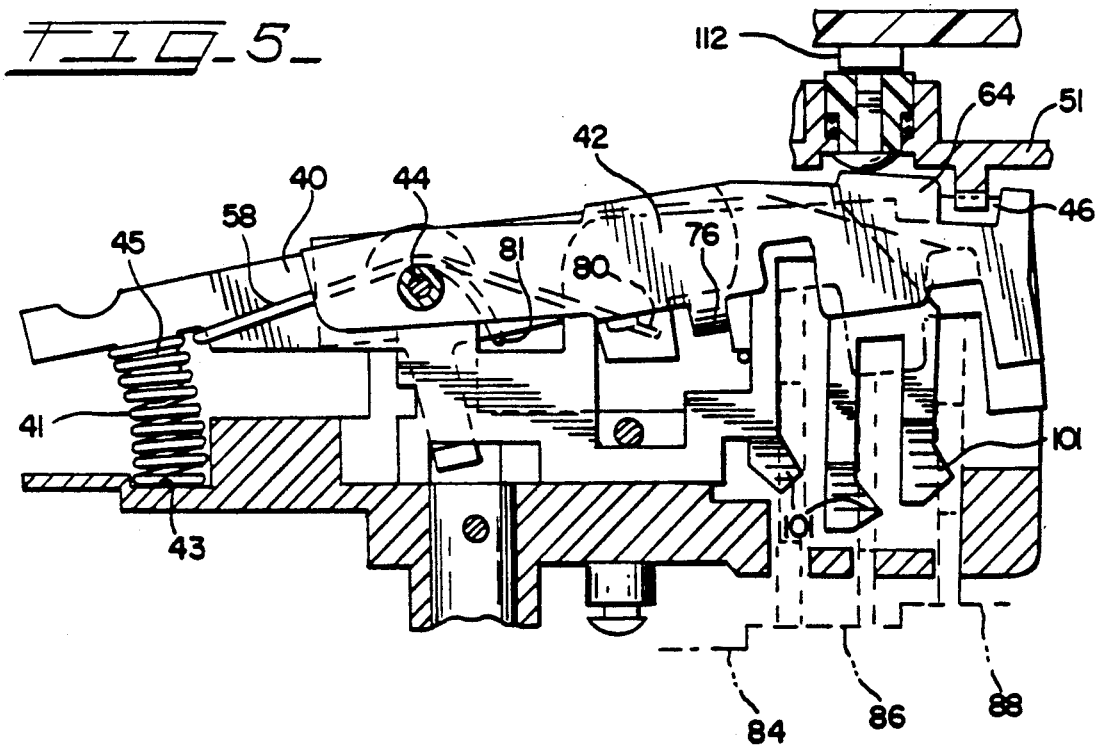
FIG. 5 is a fragmentary, horizontal sectional view of the assembly showing the coin carrier in a rotated position while carrying a coin to a switch actuating position.
Figure 6:
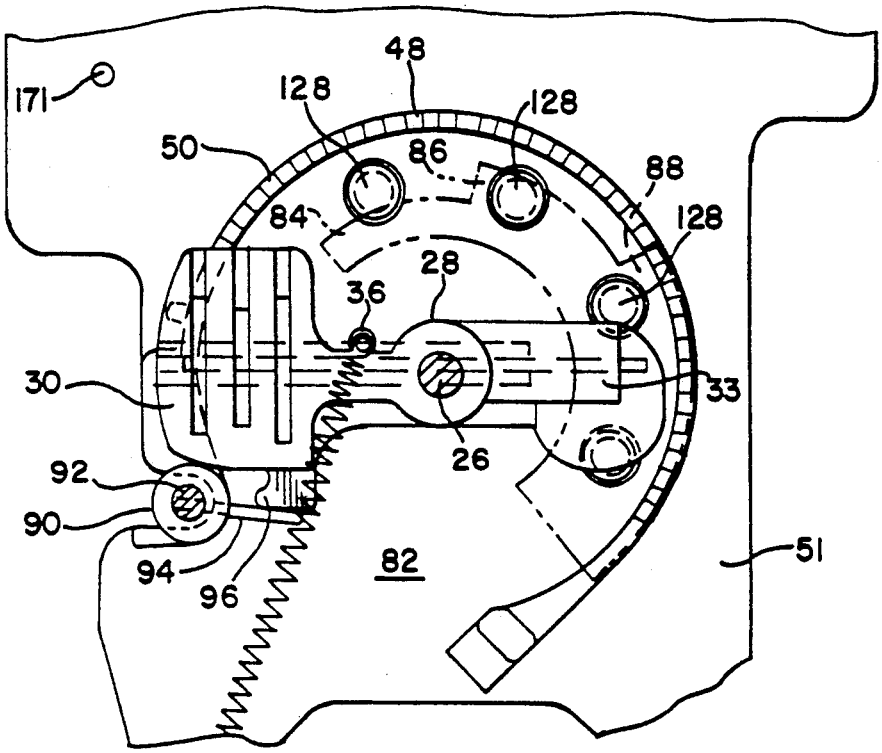
FIG. 6 is a fragmentary, elevational view of the coin carrier and switch elements of the assembly.
Figure 7:
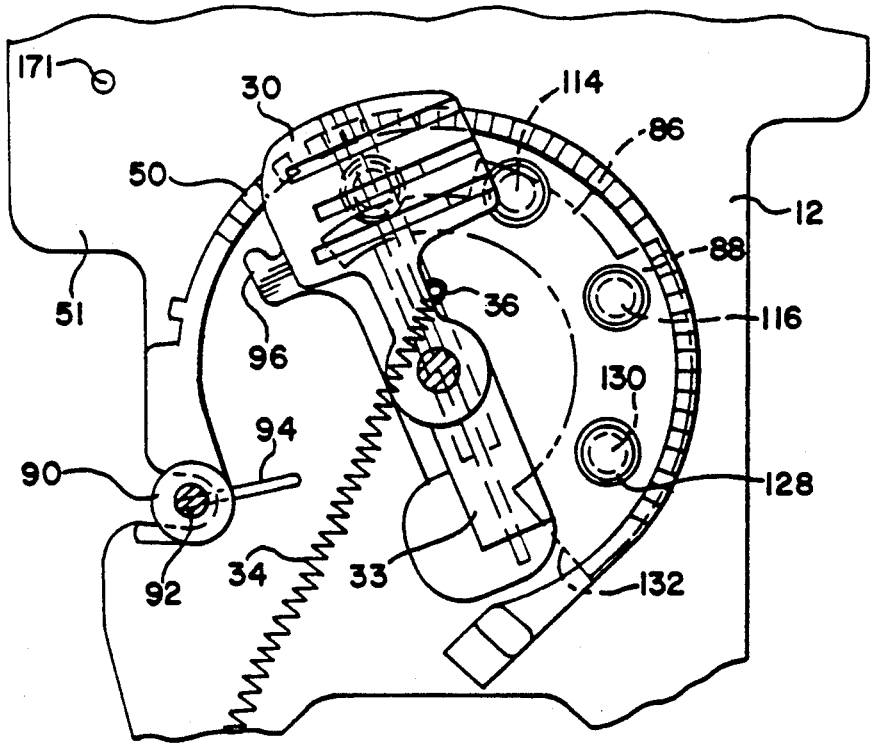
FIG. 7 is a fragmentary, elevational view of the coin carrier and switch elements of FIG. 6 moved to a switch actuating position.

The pawl 38 is adapted to be pivoted about the pin 44 to move the pawl 38 from the position shown in FIG. 4 to the position shown in FIG. 5. Recesses 52, 54 and 56 are defined by the pawl member 38 to void interference of the pawl with coins inserted into the meter. It will be noted that the recesses 52, 54 and 56 are located at different depths with respect to the member 38 to accommodate for the different diameters of coins inserted.

The pawl member 42 includes an engaging end 64 which is adapted to engage the switch actuators 128 as will be explained in greater detail. This pawl member includes recesses 70, 72 and 74, which correspond generally to the recesses 52, 54 and 56 on the pawl member 38.

Element 40 functions as a means for controlling the positions of the pawl members during the meter operation. As shown in FIGS. 4 and 5, a spring 58 associated with the element 40 includes spring ends 80 and 81 which engage the pawls 38 and 42, respectively. The spring normally urges the pawls upwardly relative to the element 40. A detent 60 is formed in the pawl member 38, and this detent normally engages the under side of the element 40. The pawl member 42 also includes a detent 76 which is also adapted to be positioned opposite the underside of the element 40. These detents, in combination with spring 58, enable the position of the pawls to be controlled by the element 40.

The element 40 is adapted to be engaged by an inserted coin, and the pawls 38 and 42 are adapted to move when the element 40 is so engaged. Specifically, the ends 80 and 81 of the spring 58 tend to force the respective detents 60 and 76 into bearing engagement with the element 40 whereby upward movement of the element 40 will enable the pawls 38 and 42 to follow in the upward direction. The element 40 is normally urged downwardly by a compression spring 41 which has one end located in the seat 43 defined in the arm 33, while the other end fits around protuberance 45 formed in the element 40. When a coin is inserted, the element 40 is moved upwardly in opposition to the spring 41.

In the normal meter operation, a coin is inserted and the handle 14 is then rotated. During this rotation, the end portion 46 of pawl member 38 rides over the teeth 48, and this pawl member is urged against these teeth by means of the end 80 of the spring 58 (see FIG. 5). The teeth 48 are designed whereby they will hold the handle against return movement due to action of the spring 34 as long as the pawl 38 is forced into engagement with these teeth.

As the rotation of the handle continues, the coin remains in the coin carrier while riding on the inner surface 82 of the panel 12. Cam segments 84, 86 and 88 are formed on this inner surface in alignment with each of the coin slots. Accordingly, each coin will engage one of these cam segments during movement of the coin carrier, and it will be appreciated that the coins are forced further into the coin carrier due to this action. This further movement of a coin will move the element 40 a corresponding distance to permit movement of the pawl 42 whereby the pawl engaging portion 64 will engage switch actuators 128 as will be explained. As previously explained, the mechanisms described, with the exception of the particular switch actuating functions, have been used before, and their operation is disclosed in the particular patents previously mentioned in that regard.

The drawings also illustrate a slug detector element 100 with protruding sensing ends 101 located in association with the pawl members and the element 40. In the embodiment disclosed, the detector element is positioned between the element 40 and the pawl member 42. A complete description of this function is found in the aforementioned U.S. Pat. No. 3,262,540.

The member 28 including coin carrier 30 is normally urged against bumper 90 by means of spring 34. This bumper is mounted on rotatable shaft 92, and the shaft carries a pin 94 engageable by extension 96 formed integrally with the coin carrier. An additional spring 102 is attached at one end to pin 104 shown in FIG. 2B and at the other end to wake-up switch actuating means 93 supported on the shaft 92. As best shown in FIG. 2B, the shaft 92 includes an extension 106 which carries wake-up switch actuating means 93. This actuating means includes engaging arm 97 for contact with extension 99 of actuating lever 101 which is engagable with button 105 of wake-up switch 110. As will be apparent, when the coin carrier is moved away from bumper 90, the shaft 92 rotates in response to the action of spring 102 which causes arm 97 to engage lever extension 99 thereby operating switch 110 as shown in dotted lines in FIG. 2B. The switch automatically reopens when the carrier is returned to its normal position.

Coin-actuated switches 112, 114, 116 and 130 are positioned on an interior wall comprising printed circuit board 109 which is positioned adjacent wall 111. Switch actuators 128 are exposed on wall 111 within the confines of the stationary ratchet 50, and these switch actuators are thereby located opposite cam segments 84, 86 and 88. FIG. 3A illustrates switch 112 and an associated actuating means, and this structure is the same for each of the other coin-actuated switches. The switch 112 includes a plunger 120 engageable by a sensor button 122. This button is positioned within a bore 124 defined by the wall 51, and a light spring 126 is positioned within the bore for normally urging the button 122 into engagement with the switch plunger 120. The spring 126 is lighter than an internal spring (not shown) for the switch 112 so that the button 122 will not normally depress the plunger for closing of the switch.

The button 122 includes a threaded bore for receiving the threaded shaft of actuator 128. It will be apparent that rotation of the actuator will result in adjustment of the distance between the actuator head and the oppositely-disposed cam segments. Accordingly, the position of the actuator head can be accurately set to insure engagement by the end 64 of pawl 42 when a coin or token of proper diameter has been inserted. On the other hand, a coin of lesser diameter will not operate to move the end 64 into engagement with the actuator screw 128. With this arrangement, for example, foreign coins which are close to the diameter of a U.S. coin but not quite large enough, will not be useful for purchasing time. Coins of too great a diameter cannot be inserted in coin slots 20.

In a typical operation, the switches 112, 114 and 116 will be employed for nickels, dimes and quarters, respectively. As will be explained in more detail, the fourth switch 130 is employed for actuation by the pawl end 64 near the completion of handle rotation and just prior to release of the coin for collection in the meter coin box. This release occurs when the coin carrier has been rotated beyond the end 132 of the segment tracks. Thus, at this point, there is a drop-off which releases the coin from the pressure exerted by spring 41.

The illustrated coin actuated-switches and related structure may be utilized in conjunction with a variety of means for recording the amount of time purchased, displaying the time remaining, and counting down the time remaining. Reference is made to the aforementioned Malott patent for an example of a system which could be utilized in conjunction with the switches and mechanical features described herein.

FIG. 8 schematically illustrates a preferred operating sequence for utilization of the features of this invention. Various conditions encountered during meter operation are described, and it will be appreciated that appropriate software can be readily obtained for achieving the sequence of operations as set forth therein.

Figure 9:
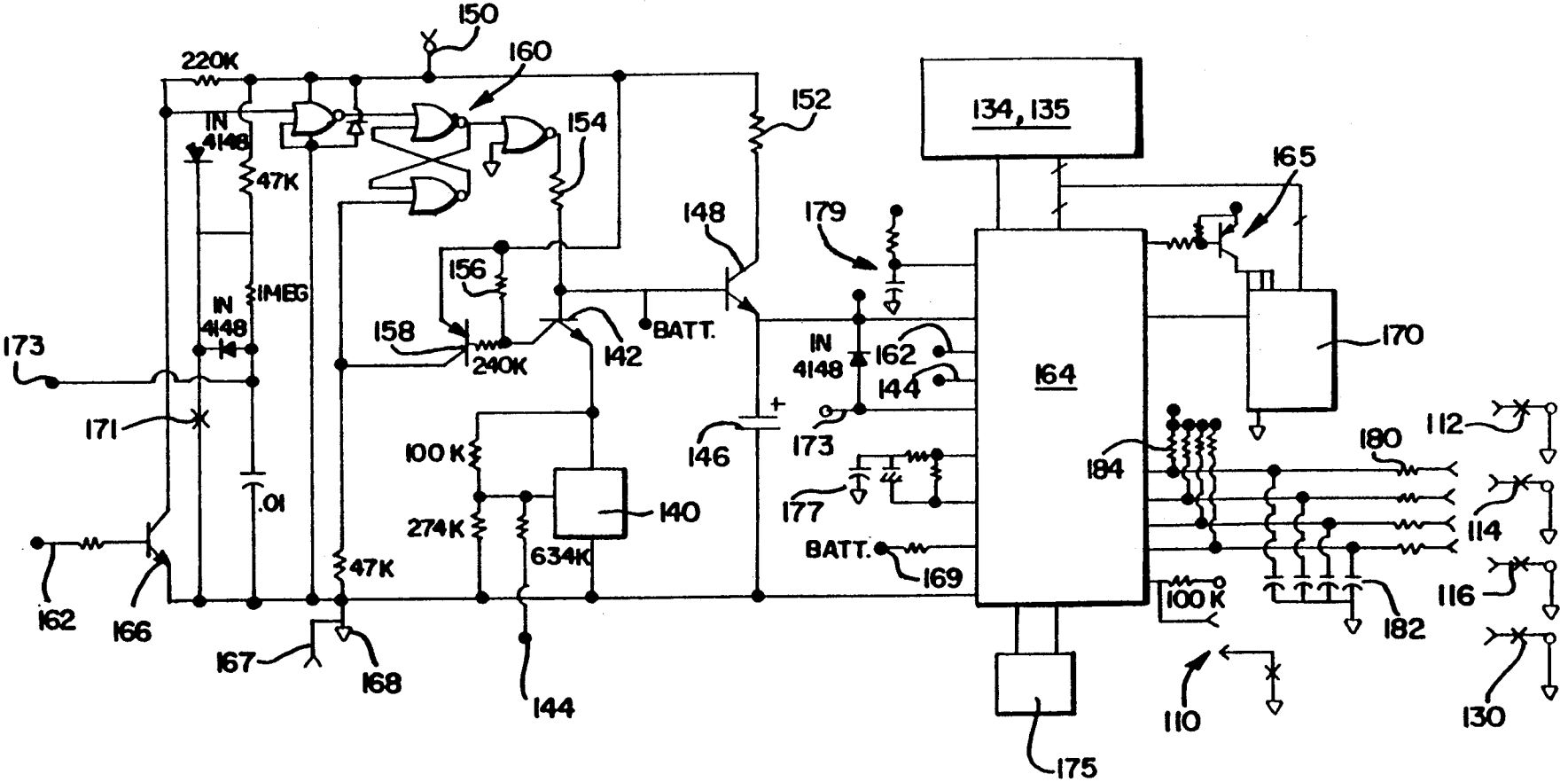

FIG. 9 illustrates in block diagram form an LCD, LED controller and display 134, 135 which may be of any conventional design and which are continuously run by a power source such as a conventional battery typically used for transistor radio operation and similar applications (nine volt nominal). The power supply is shown as battery input 150 with system ground 167, 168.

In a normal sequence of operation, the "wake-up" switch 110 is first closed as the coin carrier moves away from its normal position. This results in a signal to microprocessor 164 (COPS 344 CN, for example) which may be used to cause LCD, LED controller, display 134, 135 to "blank out" the time display and to display a red or "violation" indicator.

FIG. 8 breaks down the operating conditions into the following activity groups:

Normal time rundown
Wake-up event processing
Coin switch event detection
Manipulation event detection
Transaction completion Each of these activity groups contain a small number of actions specific to the larger activity purpose.

In the normal time rundown activity, time is deducted from the parking time clock 138 in the normal clock fashion. As will be explained in connection with the coin switch event detection activity, the LCD display 16 will be turned off and a red violation flag turned on if any of the coin switches 112, 114 or 116, or complete switch 130, or wake-up switch 110, remain closed. The LCD display will remain blank with the red flag on but time is still deducted from the internal clock 138 (after a 30-second delay as will be explained) to prevent fraudulent jamming from stopping the clock (block 140). A blank display thus indicates a trouble condition, e.g., a stuck switch or a jammed coin carrier. Once the coin and complete switches have returned to the open condition, the wake-up switch is tested (block 142). If it has changed, that is, if the coin carrier has been moved away, the wake-up event processing activity is entered.

The purpose of the wake-up event processing activity is two-fold. If the wake-up switch 110 is open ("N" or "no" condition of block 143), the display is turned back on (block 141) indicating that all switches have returned to the open condition. If the wake-up switch is closed ("Y" or "yes" condition of block 143), control passes to the coin switch event detection activity.

Upon entry of the coin switch event detection activity, the LCD display 16 is blanked (block 144), the red violation flag is turned on, and a maximum event duration timer included in microcontroller 164 is set for a sufficiently long process time limit of at least about five seconds, and preferably for about 30 seconds (block 145). This timer is decremented during coin transaction processing allowing only up to a set time, e.g., 30 seconds for processing of any single coin. If coin processing were allowed to persist indefinitely, the parking clock 138 would not run down allowing for potential fraud by engaging handle 14 away from the home (switch open) position.

The primary task performed during the coin switch event detection activity is to detect the first coin switch closed (any of switches 112, 114 or 116.) If any coin switch is detected closed (block 146), control passes to the manipulation event detection activity.

The condition for manipulation event detection is that more than one of the switches 112, 114, 116 or 130 becomes closed in a four millisecond interval (block 147). This feature is desirable since in normal operation, an interval of about 15 milliseconds is required to close any two switches in sequence. On the other hand, if a baseball bat, hammer or the like is used to strike the meter housing, it is highly likely that two or more switches will be closed simultaneously or at least within a four millisecond interval. The purpose of this activity then is to prevent granting of parking time to fraudulent use of force against the meter. If, as in legitimate operation, not more than one switch is closed in a four millisecond interval, control passes to the transaction completion activity.

The transaction completion activity scans the complete switch 130 to verify that a coin has traversed the full shuttle cycle (block 149). This feature avoids cheating which might be attempted because the coin slots make the front of the meter open to a thin probe and therefore switch 112 could be closed with such a probe. If the complete switch were not used, fraudulent time could be gained by turning the coin carrier off home and probing switch 112. The system therefore provides that only if closure of the complete switch is detected within the 30 second or other allowable time limit, then time is added to the parking clock as a function of the first coin switch closed (block 151).

Typically, the meter may be operated with a nickel, dime, or quarter wherein time is typically granted in a 1,2,5 ratio. Many other programmable features of a meter may enter into the actual time granted, e.g. deferred time, multiple split rates, time limit, free time, etc.

It will also be apparent to those skilled in the art that software can be readily designed for performing functions as described in FIG. 8. Thus, the microcontroller 164 of FIG. 9 may include a register which will be decremented within 30 seconds to provide the 30 second clock function described. Similarly, the software may simply test repeatedly for an additional closed switch to perform the four millisecond function described. Finally, such software embodies the timeclock functions contemplated for block 138 of FIG. 8.

The circuitry illustrated in FIG. 9 permits low power consumption and otherwise highly efficient operation of the parking meter or like system employing the features of the invention. In this drawing and in the following description component values and other identification are provided for illustration purposes only. It will be apparent that alternatives are available which will achieve the particular function contemplated by this invention.

More specifically, the arrangement shown in FIG. 9 particularly includes a reference diode 140 (for example, LM 385 or equivalent) which is used to provide a terminal breakdown voltage at the emitter of transistor 142 of either 3.5 volts or 5 volts depending on the voltage at the input 144. (3.5 volts with 144 at ground and 5 volts with input 144 connected to the supply output.) A 220 microfarad capacitor 146, for example, is provided across the supply terminals of the system components and at the emitter of transistor 148. The bases of transistors 142 and 148 are tied together with the collector of 148 returned to the 9-volt supply 150 through a current limiting resistor 152 (62 ohms, for example). If current is supplied through the 1k ohm resistor 154, or equivalent, connected to the bases of 142 and 148, current will flow onto the capacitor 146 until such time as it reaches the programmed breakdown voltage of the reference diode 140, at which time the base current will be shunted through the reference diode inhibiting further increase in the voltage across the capacitor 146.

Upon breakdown of the reference diode 140, the collector of transistor 142 will begin to draw current through the resistor 156 (5.1k, for example) and from the base of transistor 158 causing the collector of 158 to rise rapidly to the 9 volt supply voltage. (This signal can be used to determine that regulation has been achieved.) The control element, which is a set-reset latch 160 formed, for example, by cross connecting the NOR elements of a CD4001 integrated circuit, can be set by activation of the input 162 from the microcontroller 164 through a level shifting transistor 166. The output of this latch provides current through the resistor 154 to the regulator. The latch will remain set until regulation is achieved at which time the signal from the collector of transistor 158 resets the latch.

In normal operation, the microcontroller 164 will provide pulses to the regulation sub-system control input 162 at a rate of about 1 per second. Typically, the regulator latch 160 will remain set for only about 0.5 milliseconds. This results in a net current drain into the voltage reference which is reduced by a factor of about 2000, while achieving sufficient regulation for operation of the CMOS system components.

An output 169 from the regulation sub-system is provided for signalling the microcontroller at 169 so that the duration of the latch set period can be monitored. If this output remains activated for a time exceeding 2 milliseconds, for example, this indicates an end of service life for the battery, and a display, such as decimal points, may be provided at 16 to alert maintenance personnel that a battery change is needed.

In an alternate mode, with control input 162 held by the microcontroller at a high level, and with input 144 likewise held high, the regulation system acts as a continuous duty 5 volt series pass regulator. By thus holding input 162 high, the regulator latch 160 is prevented from resetting thereby maintaining continuous regulation. This mode is used during reading of the NOVRAM device 170. In this instance, the high power consumption of a series regulator occurs only during the short interval (for example, a few milliseconds) needed to store the NOVRAM data in the microcontroller 164. A normally off switch 165 is used to prevent draining of power to NOVRAM 170 during periods when reading is not taking place.

A communications input/output function is provided at 175 for purposes of changing the operating program, e.g., if it is desired to change the amount of time allotted for a given coin or coins, or to switch to a maximum revenue production mode where time is erased if additional purchase is attempted after a given time interval. In addition, the communication function may include an audit of the meter. During communication mode, the microcontroller utilizes the power sub-system in a 3.5 volt series regulation mode, e.g., with control input 162 held high and input 144 held low.

A manually engageable reset switch 171 is accessible upon unlocking and opening mechanism housing, since, in the usual fashion, the timing mechanism is removably attached to posts 22. The reset switch 171 is operated, for example, when the mechanism is first installed in an existing meter, or when a battery is changed. Referring to FIG. 9, the reset switch 171 bypasses the action of control input 162 through transistor 166 to the regulation system thereby forcing the regulation system to enter the series pass regulation mode. Further, output 173 signals the microprocessor that there is a reset condition.

FIG. 9 illustrates additional means for achieving power conservation during operation of the described mechanism. Specifically, the switches 112, 114, 116 and 130 are connected through resistors 180 to capacitors 182. The resistors 180 are of low resistance, and the capacitors are rapidly charged upon closing of switches. Accordingly, only a short interval of power application is required for charging the capacitors.

The capacitors are discharged through resistors 184 which are of substantially higher resistance, for example 100K. The result is that the discharge of the capacitors at a substantially slower rate (on the order of 10 milliseconds) whereby the microprocessor 164 has substantial time to factor in the switch closing event. The microprocessor, therefore, does not need to operate at a high rate with proportionally higher power consumption in order to perform the functions contemplated by the invention. This "pulse stretching" feature is particularly advantageous where, as here, a coin switch may be closed for less than 500 microseconds, and the microcontroller would be required to operate with higher power consumption if only this short duration signal were being processed.

The clock function 138 more particularly may involve conventional use of a crystal controlled time base oscillator 177 (32.76 KHZ, e.g.) to perform the timing function. In a form of operation, a supplemental timing function may be performed using oscillator 179 operated at a higher rate (e.g., 500 KHZ). This oscillator is used during performance of coin processing function 151, allowing the meter to achieve a high response rate for coin processing.

It will be understood that various changes and modifications may be made in the above described invention without departing from the spirit thereof particularly as defined in the following claims.

We claim:

1. A method of operating a coin-operated mechanism for purchasing time, the mechanism being equipped with a plurality of separate switch-actuator pairs, each of said pairs comprising a switch and an actuator for actuating said switch, a coin carrier movable adjacent each said actuator, each said actuator being successively engageable by said coin carrier, and means for recording the time purchased, the method including the steps of inserting a coin in the carrier, moving the carrier to engage said actuators, collecting the coin, and recording the time purchased, and further including the step of rendering said recording means inoperative when more than one of said switches are actuated substantially simultaneously by their respective actuators.

2. A method is accordance with claim 1 comprising the step of rendering said recording means inoperative when more than one of said switches is actuated within a time interval of about four milliseconds or less.

3. A method is accordance with claim 1 additionally comprising the step of rendering said recording means inoperative when a first switch is engaged but a second switch has not been engaged within from between about at least five seconds and about 30 seconds after said first switch is engaged.

4. A method in accordance with claim 3 comprising the steps of setting a clock to measure the time elapsed after the first switch is engaged, and signalling said recording means by means of said clock when said at least five seconds has elapsed.

* * * * *